United States Patent [19]

Meyrat

[11] Patent Number: 4,794,577

[45] Date of Patent: Dec. 27, 1988

[54] WATCH MIDDLE AND WRISTLET ASSEMBLY

[75] Inventor: Clément Meyrat, Le Landeron, Switzerland

[73] Assignee: ETA SA Fabriques d'Ebauches, Granges, Switzerland

[21] Appl. No.: 39,857

[22] Filed: Apr. 20, 1987

[30] Foreign Application Priority Data

May 7, 1986 [CH] Switzerland ..... 01872/86

[51] Int. Cl.[4] ..... G04B 37/00

[52] U.S. Cl. ..... 368/282; 224/164; 224/180

[58] Field of Search ..... 224/168–180; 368/281–282

[56] References Cited

U.S. PATENT DOCUMENTS

| | | | |
|---|---|---|---|
| 3,165,884 | 1/1965 | Gwinner | 368/282 |
| 4,068,355 | 1/1978 | Rey | 24/265 R |
| 4,432,654 | 2/1984 | Hesselschwerdt | 368/282 |
| 4,432,655 | 2/1984 | Wollman | 224/164 |

FOREIGN PATENT DOCUMENTS

| | | | |
|---|---|---|---|
| 8205042 | 8/1982 | Fed. Rep. of Germany . | |
| 1015737 | 10/1952 | France . | |
| 1399320 | 6/1964 | France . | |
| 179155 | 8/1935 | Switzerland . | |
| 526148 | 3/1972 | Switzerland . | |
| 576760 | 6/1976 | Switzerland . | |
| 865498 | 4/1961 | United Kingdom | 368/282 |
| 2163038 | 2/1986 | United Kingdom | 224/164 |

*Primary Examiner*—Bernard Roskoski

*Attorney, Agent, or Firm*—Pollock, Vande Sande & Priddy

[57] ABSTRACT

To avoid having to pierce them, which would be detrimental to their mechanical resistance to pull, the end portions (5, 6) of the wristlet are retained in slots (3, 4) provided in the watch-case middle (1) by pins (7, 8) partly accommodated in grooves (9, 10) formed in one surface of the slots (3, 4).

10 Claims, 1 Drawing Sheet

WATCH MIDDLE AND WRISTLET ASSEMBLY

BACKGROUND OF THE INVENTION

1. Field of the Invention

This invention relates to an assembly of the kind comprising a watch-case element including a middle bounded by a lower surface, an upper surface and a side surface, and further comprising a wrislet having an end portion accommodated in a recess formed in said middle and opening in said side surface, and means for retaining said end portion in said recess.

2. Prior Art

Assemblies of the above kind are disclosed for instance in Swiss patent specifications Nos. CH-A-179155 and CH-B-526148, in French patent specification No. FR-B-1399320 and in German utility model specification No. DE-U-8205042.

In all of these assemblies, the means for retaining a wristlet's end portions, nearest a watch case, inside recesses formed in the case's middle, consist of pins, screws or rivets extending through the wristlet and at least part of the middle in a direction substantially perpendicular to the plane of the wristlet.

The holes made in the wristlet for these pins, screws or rivets promote later tearing as they reduce the wristlet's mechanical resistance to pull.

SUMMARY OF THE INVENTION

An object of the invention is to provide an assembly of the kind set forth which does not suffer from this drawback, i.e. wherein the retaining means do not require holes being made in the wristlet. The wristlet's mechanical resistance to pull is therefore not affected by such holes. To this end the invention provides an assembly of the above kind wherein said retaining means include a cavity opening at least partly into said recess and extending in a direction substantially parallel to one of said surfaces and substantially perpendicular to the length of said wristlet, and an elongated retaining element accommodated in said cavity and occupying part of said recess.

BRIEF DESCRIPTION OF THE DRAWINGS

In the accompanying diagrammatic drawings, given by way of example.

DETAILED DESCRIPTION

Figure 1:
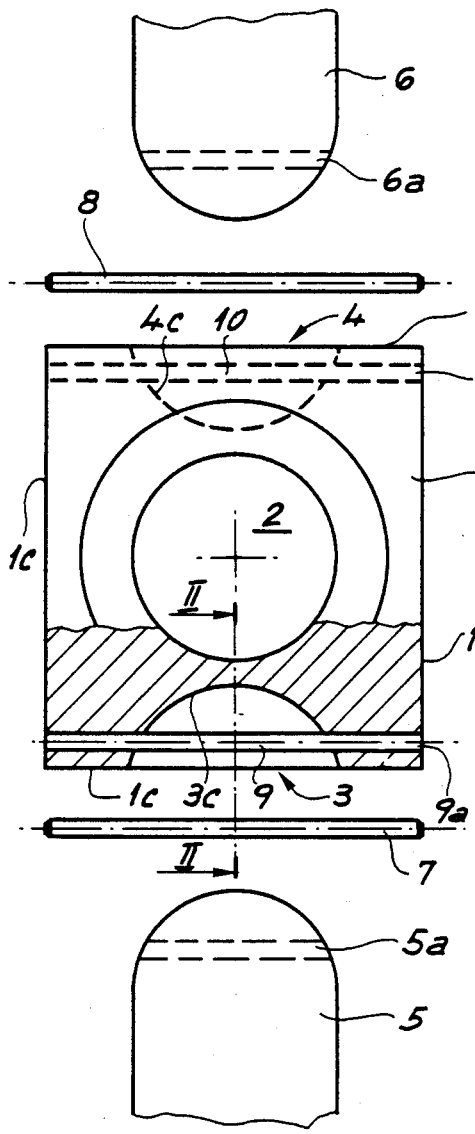
FIG. 1 is a plan view of the components of an assembly according to the invention, with one component shown in partial section along line I—I of FIG. 2.
Figure 2:
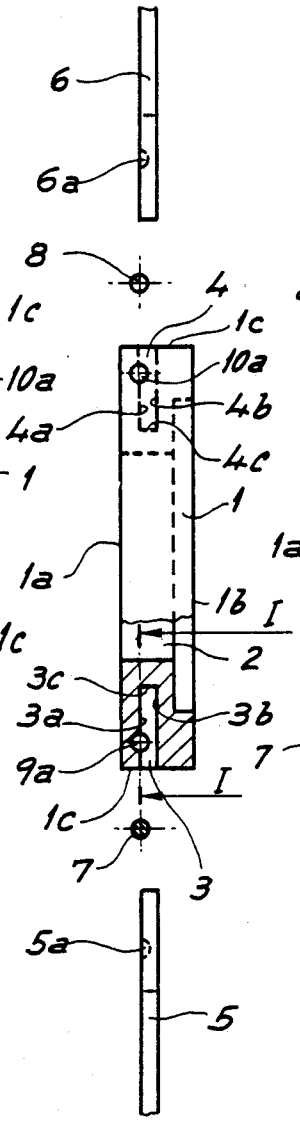
FIG. 2 is an elevational view of the components of FIG. 1, shown partly in section along line II—II of FIG. 1.
Figure 3:
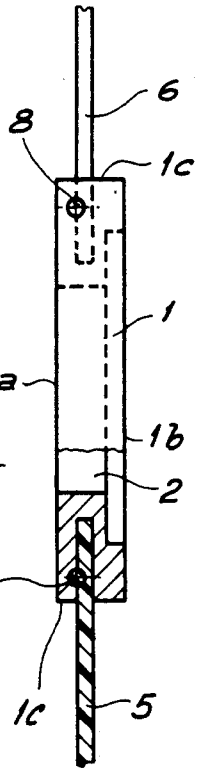
FIG. 3 is an elevational view of an actual assembly according to the invention, comprising the components of FIGS. 1 and 2, shown partly in section.

Like the assemblies disclosed in the above listed specifications, that shown diagrammatically in FIGS. 1 to 3 comprises a watch-case element consisting, here, of a middle 1.

Middle 1 is provided, in well-known manner, with means for securing a back cover, not shown, to its lower surface 1*a* and a glass, not shown either, to its upper surface 1*b*.

Middle 1 and its associated back cover and glass define a housing for accommodating the movement and, as the case may be, the dial and the hands for showing the time. These parts and the means for securing the movement to middle 1 have not been shown.

Middle 1 is also formed with recesses for receiving the end portions of a wristlet. These recesses consist of oppositely directed slots 3 and 4 that open in the side surface 1*c* of middle 1 and that are bounded by two pairs of flat and parallel surfaces 3*a*, 3*b* and 4*a*, 4*b*, and by bottom surfaces 3*c* and 4*c*. Surfaces 3*c* and 4*c* have here a rounded shape. In the illustrated embodiment, the surfaces 3*a*, 3*b*, 4*a* and 4*b* of slots 3 and 4 are also parallel to the upper and lower surfaces of middle 1.

The width of slots 3 and 4, i.e. the distance separating surface 3*a* from surface 3*b* and surface 4*a* from surface 4*b*, is roughly equal to the thickness of the wristlet forming part of the assembly shown in FIGS. 1 to 3. Only the end portions, 5 and 6, of the wristlet that are meant to be secured to middle 1 have been shown.

For a reason which will become apparent later, end portions 5 and 6 are here assumed to be made of a compressible material such as certain kinds of leather, rubber and plastic. The entire wristlet may of course be made of the same material.

In the assembly shown in FIGS. 1 to 3, the means for retaining wristlet end portions 5 and 6 comprise elongated retention elements consisting here of cylindrical pins 7 and 8.

The means for retaining wristlet end portions 5 and 6 also comprise cavities that are able to receive pins 7 and 8 and which here consist of grooves 9 and 10 formed in surfaces 3*a* and 4*a* of slots 3 and 4. Grooves 9 and 10 extend in a direction substantially perpendicular to the length of the wristlet and parallel to the lower surface 1*a* of middle 1.

The cavities for pins 7 and 8 also include cylindrical holes 9*a* and 10*a* that are drilled in middle 1 in alignment with grooves 9 and 10, with a diameter roughly equal to that of pins 7 and 8.

Grooves 9 and 10 are for instance produced by first drilling holes 9*a* and 10*a* in middle 1, where required, before milling slots 3 and 4.

A cross-section of grooves 9 and 10 in a plane perpendicular to surfaces 3*a* and 4*a* and parallel to the direction of the wristlet's length is thus arcuate with a radius equal to that of holes 9*a* and 10*a*.

If middle 1 is made of mouldable plastic, slots 3 and 4 and grooves 9 and 10 may be produced by suitably shaping the mould used to make middle 1.

Pins 7 and 8 may be made of any suitable metal or plastic.

The finished assembly as shown in FIG. 3 involves first inserting wristlet end portions 5 and 6 into slots 3 and 4. Pins 7 and 8 are then inserted into holes 9*a* and 10*a* and, because of the compressibility of wristlet end portions 5 and 6, along grooves 9 and 10. Pins 7 and 8 thus occupy part of slots 3 and 4 for accommodating wristlet end portions 5 and 6. The latter are therefore urged back by pins 7 and 8 against surfaces 3*b* and 4*b* of slots 3 and 4. The frictional forces that come into play between the various surfaces that are in contact with one another firstly keep wristlet end portions 5 and 6 in slots 3 and 4 and secondly prevent pins 7 and 8 from moving along their axes. In this way, end portions 5 and 6 can effectively be retained in slots 3 and 4 without being pierced.

A pull on end portions 5 and 6 will generally tend to urge pins 7 and 8 out of grooves 9 and 10 thereby increasing the frictional action of end portions 5 and 6 against pins 7 and 8 and against walls 3*b* and 4*b* of slots 3 and 4 and hence improving further the bond between the wristlet and middle 1.

For end portions 5 and 6 to be properly retained in slots 3 and 4 they must of course extend into the latter beyond grooves 9 and 10. Slots 3 and 4 must therefore be deep enough. Preferably, end portions 5 and 6 should have a shape such that they will come into contact with the whole area of bottom surfaces 3*c* and 4*c* of slots 3 and 4. End portions 5 and 6 are therefore provided with rounded ends having substantially the same radius as bottom surfaces 3*c* and 4*c*.

The diameter of pins 7 and 8 and the depth of grooves 9 and 10 depend on the material chosen for end portions 5 and 6.

If the material is highly deformable, like some kinds of rubber and plastic, it is best for pins 7 and 8 to have a diameter greater than the width of slots 3 and 4 and/or for grooves 9 and 10 to have a depth such that, when the assembly has been put together, the axes of pins 7 and 8 lie outside of grooves 9 and 10 in slots 3 and 4, i.e. lie between surfaces 3*a* and 3*b* and surfaces 4*a* and 4*b*.

But if the material selected for end portions 5 and 6 is only slightly deformable, like certain kinds of leather and plastic, it may be best for pins 7 and 8 to have a diameter less than the width of slots 3 and 4, and/or for grooves 9 and 10 to have a depth such, when the assembly has been put together, the axes of pins 7 and 8 lie in the planes of surfaces 3*a* and 4*a* of slots 3 and 4 or outside these surfaces, i.e. within grooves 9 and 10.

However, the diameter of pins 7 and 8 must always be greater than the depth of grooves 9 and 10.

When end portions 5 and 6 are made of certain kinds of material such as some types of rubber and plastic, they may tend to flow in response to the pull that is normally exerted on these end portions. After a while this flow can cause end portions 5 and 6 to issue from slots 3 and 4.

This flow problem can be countered by providing grooves 5*a* and 6*a*, shown in broken lines, in end portions 5 and 6 where the latter come into contact, in the finished assembly, with pins 7 and 8. The depth of grooves 5*a* and 6*a* will depend on the material used for end portions 5 and 6 and must as a general rule be less than the difference between the diameter of pins 7 and 8 and the depth of grooves 9 and 10.

These grooves are preferably produced without removal of matter from end portions 5 and 6, e.g. by permanent deformation of end portions 5 and 6 with the aid of a suitably shaped tool applied with force in the apposite locations. This tool may possibly be heated to facilitate such permanent deformation.

The invention is not limited to cases where end portions 5 and 6 are made of deformable material.

If end portions 5 and 6 are made of a material that is difficult to deform, e.g. a hard plastic or a metal, end portions 5 and 6 are formed with grooves similar to grooves 5*a* and 6*a* but having a shape and arrangement such than when end portions 5 and 6 are engaged in slots 3 and 4 they form with grooves 9 and 10 cylindrical cavities having a diameter that is preferably slightly less than that of pins 7 and 8. In this way, the latter stay in place by friction after having been forced into these cavities, thereby to hold end portions 5 and 6 in slots 3 and 4.

For aesthetic reasons, grooves 9 and 10 are preferably made in surfaces 3*b* and 4*b* of slots 3 and 4, i.e. those surfaces which in the finished watch are located nearest the case's back cover. But these grooves may also be made in surfaces 3*a* and 4*a* of slots 3 and 4, i.e. those surfaces which in the finished watch are located nearest the watch's glass.

It is also possible to make grooves similar to grooves 9 and 10 both in surfaces 3*a* and 4*a* and 3*b* and 4*b* of slots 3 and 4. Four pins similar to pins 7 and 8 are then fitted in these grooves thereby holding end portions 5 and 6 in slots 3 and 4 still better.

Pins 7 and 8, or the above four pins, may have a non-circular cross-section instead of a circular one, e.g. oval or polygonal. In this event, the grooves formed in the surfaces of slots 3 and 4 and in end portions 5 and 6, if any, should be correspondingly shaped.

The dimension of the pins in a direction perpendicular to the plane of surfaces 3*a*, 4*a*, 3*b* and 4*b* should then, of course, be greater than the depth of the grooves formed in these surfaces when the pins are in position.

The invention may also be carried into effect regardless of the shape of middle 1 and/or even if middle 1 and the case's back cover are integral.

Further, bottom surfaces 3*c* and 4*c* may have a shape other than the semi-circular shape shown in FIGS. 1 to 3. Slots 3 and 4 may for instance be produced by moving a milling cutter of suitable thickness in a direction perpendicular to the length of the wristlet across the entire width of middle 1. In such a case, bottom surfaces 3*c* and 4*c* are flat and extend through middle 1 from edge to edge. Holes 9*a* and 9*b* cease to exist and the cavities for pins 7 and 8 are simply formed by grooves 9 and 10 which extend across the whole width of middle 1.

Bottom surfaces 3*c* and 4*c* may also have other shapes, in particular when middle 1 is made of a moulded plastic.

The wristlet's end portions 5 and 6 may have a width equal to or even greater than the width of middle 1. The wristlet, or at least its end portions, may consist of a cord, e.g. of cylindrical shape, having a cross-sectional dimension less than the thickness of middle 1. In this case, the recesses for the wristlet's end portions may consist of mere blind holes of suitable cross-section that are drilled in opposite locations in the peripheral wall of middle 1.

Also, the length of pins 7 and 8 may be less than the total length of the cavities formed by grooves 9 and 10 and by holes 9*a* and 10*a*, if any, and even less than the length of grooves 9 and 10. In such cases, the open ends of holes 9*a* and 10*a* may be closed off by plugs made, for instance, of the same material as middle 1. When provided, holes 9*a* and 10*a* may also be blind, i.e. may only open at one of their ends in the side surface of middle 1.

Further, surfaces 3*a* and 3*b* and surfaces 4*a* and 4*b* need not be parallel to the planes of the upper and lower surfaces 1*a* and 1*b* of middle 1, but may form with these planes angles greater than 0° whereby the wristlet's end portions 5 and 6 may have, adjacent middle 1, a shape such that the wristlet will conform closely to the wearer's wrist.

These various forms of embodiment of the assembly according to the invention have not been illustrated since they may be produced without any difficulty by a man of the art.

I claim:

1. An assembly comprising:

(a) a watch-case element including a middle bounded by a lower surface, an upper surface and an edge surface, and formed with a recess, said recess having an opening in said edge surface and being separated from one of said lower and upper surfaces by a wall;

(b) a wristlet having an end portion accommodated in said recess; and, (c) means for retaining said end portion in said recess including an elongated retention element extending in a direction substantially parallel to one of said upper and lower surfaces and substantially perpendicularly to the length of said wristlet, said retention element extending through said recess and cooperating with said middle for urging said end portion of said wristlet against said wall and for providing thereby frictional forces between said end portion of said wristlet and corresponding portions of said wall and said retention element respectively, said frictional forces alone causing said end portion of said wristlet to be retained in said recess.

2. An assembly as in claim 1, wherein said recess has the form of a slot separated from the other of said lower and upper surfaces by a second wall, said walls being spaced apart by a distance substantially equal to the thickness of said wristlet end portion, and wherein said elongated retention element is partially disposed in a groove opening in said second wall.

3. An assembly as in claim 1, further comprising an aperture in said middle which opens into said recess, extends co-axially with said retention element and opens in said edge surface of said middle at an end remote from said recess, said aperture having transversal dimensions adapted for allowing said elongated retention element to pass through it.

4. An assembly as in claim 3, further comprising a plug closing off said aperture at said end remote from said recess.

5. An assembly as in claim 1, wherein said retaining means further includes a groove provided in said end portion of the wristlet, and wherein said elongated retention element is partially disposed in said groove.

6. An assembly as in claim 2, wherein said retaining means further includes a second groove provided in said end portion of the wristlet, and wherein said elongated retention element is also partially disposed in said second groove.

7. An assembly as in claim 1, wherein said elongated retention element has substantially the same cross-section over its entire length.

8. An assembly as in claim 1, wherein opposite end portions of said elongated retention element are retained in corresponding holes in said watch-case middle solely by frictional forces caused by said retention element urging said end portion of the wristlet against said wall.

9. An assembly comprising:

(a) a watch-case element including a middle bounded by a lower surface, an upper surface and an edge surface, and formed with a recess, said recess having an opening in said edge surface and being separated from one of said lower and upper surfaces by a wall;

(b) a wristlet having an end portion made of a compressible material, said end portion being accommodated in said recess; and (c) means for retaining said end portion in said recess including an elongated retention element extending in a direction substantially parallel to one of said upper and lower surfaces and substantially perpendicularly to the length of said wristlet, said retention element extending through said recess and cooperating with said middle for so deforming said end portion of said wristlet that it is forcedly urged against said wall, that frictional forces are provided between said end portion of said wristlet and corresponding portions of said wall and said retention element respectively, and that said frictional forces alone cause said end portion of said wristlet to be retained in said recess.

10. An assembly comprising:

(a) a watch-case element including a middle bounded by a lower surface, an upper surface and an edge surface, and formed with a recess, said recess having a first opening in said edge surface and being separated from one of said lower and upper surfaces by a wall;

(b) a wristlet having an end portion accommodated in said recess; and, (c) means for retaining said end portion in said recess including a cavity in said middle intersecting said recess and comprising a second opening in said edge surface, and an elongated retention element extending in a direction substantially parallel to one of said upper and lower surfaces and substantially perpendicularly to the length of said wristlet, said retention element being disposed in said cavity and extending through said recess for urging said end portion of said wristlet against said wall and for providing thereby frictional forces between said end portion of said wristlet and corresponding portions of said wall and said retention element respectively, said frictional forces alone causing said retention element to be retained in said cavity and said recess and the end portion of said wristlet to be retained in said recess.

* * * * *